US006880713B2

(12) United States Patent
Holley, Jr.

(10) Patent No.: US 6,880,713 B2
(45) Date of Patent: Apr. 19, 2005

(54) FLOW CONTROL ELEMENT WITH PINHOLES FOR SPILL-RESISTANT BEVERAGE CONTAINER

(75) Inventor: James W. Holley, Jr., Colorado Springs, CO (US)

(73) Assignee: Insta-Mix, Inc.,, Colorado Springs, CO (US)

( * ) Notice: Subject to any disclaimer, the term of this patent is extended or adjusted under 35 U.S.C. 154(b) by 0 days.

(21) Appl. No.: 10/339,861

(22) Filed: Jan. 10, 2003

(65) Prior Publication Data

US 2004/0045922 A1 Mar. 11, 2004

Related U.S. Application Data

(63) Continuation-in-part of application No. 10/236,459, filed on Sep. 6, 2002, now abandoned.

(51) Int. Cl.[7] ..... A61J 9/00; A61J 11/00; B26F 1/00

(52) U.S. Cl. ..... 215/11.4; 215/11.1; 220/714; 30/368

(58) Field of Search ..... 215/11.1, 11.4, 215/11.5; 220/711, 714; 30/368

(56) References Cited

U.S. PATENT DOCUMENTS

| | | | | |
|---|---|---|---|---|
| 1,360,893 A | | 11/1920 | Cowie | |
| 1,794,728 A | | 3/1931 | Oliver | |
| 2,075,137 A | | 3/1937 | Rosen | |
| 2,187,558 A | | 1/1940 | Kushima | |
| 2,588,069 A | | 3/1952 | Allen | |
| 2,889,829 A | * | 6/1959 | Tannenbaum et al. | 606/236 |
| 3,047,950 A | * | 8/1962 | Stasiuk | 30/368 |
| 4,981,022 A | | 1/1991 | Snyder | |
| 5,044,173 A | | 9/1991 | Cheng | |
| 5,090,213 A | | 2/1992 | Glassman | |
| 5,186,347 A | | 2/1993 | Freeman et al. | |
| 5,271,244 A | | 12/1993 | Staggs | |
| 5,284,028 A | | 2/1994 | Stuhmer | |
| 5,300,089 A | * | 4/1994 | Sassin | 606/236 |
| 5,410,814 A | * | 5/1995 | Caban | 30/368 |
| 5,499,729 A | | 3/1996 | Greenwood et al. | |
| 5,597,087 A | | 1/1997 | Vinarsky | |
| 5,706,973 A | | 1/1998 | Robbins, III et al. | |
| 5,875,646 A | | 3/1999 | Rich | |
| 6,042,850 A | * | 3/2000 | Ida et al. | 426/2 |
| 6,102,245 A | | 8/2000 | Haberman | |
| 6,123,065 A | | 9/2000 | Teglbjarg | |
| 6,422,415 B1 | | 7/2002 | Manganiello | |
| 6,502,418 B1 | | 1/2003 | Holley, Jr. | |
| 6,508,379 B1 | * | 1/2003 | Van De Pol-Klein Nagelvoort et al. | 220/714 |
| 2001/0020623 A1 | | 9/2001 | McDonough et al. | |
| 2002/0011583 A1 | | 1/2002 | Getzewich et al. | |
| 2002/0063103 A1 | * | 5/2002 | Kiernan | |
| 2002/0066714 A1 | * | 6/2002 | Rees | |

FOREIGN PATENT DOCUMENTS

| | | | | |
|---|---|---|---|---|
| FR | 571788 | * | 5/1924 | |
| FR | 1189334 | * | 10/1959 | 215/11.1 |
| FR | 2302724 | * | 10/1976 | 215/11.1 |
| GB | 529438 | * | 11/1940 | 215/11.1 |

* cited by examiner

*Primary Examiner*—Sue A. Weaver
(74) *Attorney, Agent, or Firm*—Bever, Hoffman & Harms LLP; Patrick T. Bever

(57) ABSTRACT

A spill resistant container (e.g., a sippy cup) including a flow control element including a membrane defining multiple pinholes for controlling the flow of liquid through a drinking spout. The flow control element is mounted on a cover that screws onto a cup-shaped body such that the membrane is positioned between liquid stored in the cup-shaped body and the drinking spout, which is formed on the cap. The flow control element is formed from a suitable elastomeric material (e.g., soft rubber, thermoplastic elastomer, or silicone) such that the membrane stretches when subjected to a differential pressure. The pinholes are formed by puncturing the membrane using one or more pins having a substantially circular cross-section and sized such that each pinhole is closed by the surrounding elastomeric material when the pins are removed.

17 Claims, 2 Drawing Sheets

FLOW CONTROL ELEMENT WITH PINHOLES FOR SPILL-RESISTANT BEVERAGE CONTAINER

RELATED APPLICATION

The present application is a continuation-in-part of commonly owned U.S. patent application Ser. No. 10/236,459, "FLOW CONTROL ELEMENT WITH PINHOLES FOR SPILL-RESISTANT BEVERAGE CONTAINER" filed Sep. 6, 2002 now abandoned by James W. Holley, Jr.

FIELD OF THE INVENTION

The present invention relates to fluid containers, and more particularly to spill-resistant beverage containers.

RELATED ART

Spill-resistant containers are widely used for storing liquids in situations where the liquid may spill from an open-top cup. For example, travel mugs have lids or caps that resist accidental spillage of liquid that slosh due to rough road conditions. A drinking hole is provided in the lids or caps through which liquids (e.g., coffee) may be sipped by a person traveling in an automobile, and an air inlet hole is provided that admits air to replace the volume of beverage sipped from the travel mug. Sports bottles are another type of spill-resistant container that typically includes a screw-on lid having a built-in straw, and a cap for sealing the end of the straw. Some of these sports bottles also have a manually operated pop-up air intake vent that admits air to replace the volume of beverage drawn through the straw.

Sippy cups are a third type of spill-resistant container typically made for children. Sippy cups include a cup body and a screw-on or snap-on lid having a drinking spout molded thereon. An elastomeric flow control element, such as a soft rubber or silicone outlet valve, is provided in some sippy cups to control the flow of liquid through the drinking spout. Such flow control elements typically include a sheet of the elastomeric material located between the inner cup chamber and the drinking spout that defines one or more slits formed in an X or Y pattern. As a child tilts the container and sucks liquid through the drinking spout, the slits yield and the flaps thereof bend outward, thereby permitting the passage of liquid to the child. When the child stops sucking, the resilience of the causes the slits to close once more so that were the cup to be tipped over or to fall on the floor, no appreciable liquid would pass out the drinking spout. The lid often also includes an air inlet port (vent) formed to admit air into the cup body to replace the volume of liquid sipped or sucked through the drinking spout, and a rubber or spring-loaded self-sealing air inlet control valve is sometimes provided to prevent spillage through the air inlet.

A problem with conventional sippy cups that utilize elastomeric flow control elements is that the elastomeric material in the region of the slits can fatigue and/or become obstructed over time, and the resulting loss of resilience can cause leakage when the slit flaps fail to fully close after use. This failure of the slit flaps to close can be caused by any of several mechanisms, or a combination thereof. First, repeated shearing forces exerted at the end of each slit due to repeated use can cause tearing of the elastomeric material in this region, thereby reducing the resilient forces needed to close the slit flaps after use. Second, thermal cycling or mechanical cleaning (brushing) of the elastomeric material due, for example, to repeated washing, can cause the elastomeric material to become less elastic (i.e., more brittle), which can also reduce the resilience of the slit flaps. Third, solid deposits left by liquids passing through the slits can accumulate over time to impede the slit flaps from closing fully.

What is needed is a spill-resistant beverage container including an elastomeric flow control element that avoids the problems associated with conventional slit-based elastomeric flow control elements.

SUMMARY

The present invention is directed to a spill resistant container (e.g., a sippy cup, travel mug, or sports bottle) including a flow control element including a membrane defining multiple pinholes, instead of conventional slits, for controlling the flow of liquid through a drinking spout. The membrane is formed at one end of a cylindrical wall formed such that the flow control element can be mounted on a corresponding cylindrical mounting structure formed on a cover that screws onto a cup-shaped body. In one embodiment, the cylindrical wall is mounted over the mounting structure and a relatively large diameter membrane is positioned at an end of the mounting structure away from the drinking spout, which is formed on the cap. In a second embodiment the cylindrical wall of the flow control element is pushed into the mounting structure such that a relatively small diameter membrane is located adjacent to the drinking spout. In either embodiment, the membrane is positioned between liquid stored in the cup-shaped body and the drinking spout. The flow control element is formed from a suitable elastomeric material (e.g., soft rubber, thermoplastic elastomer, or silicone) such that the membrane stretches when subjected to a differential pressure (e.g., as a result of a child sucking on the drinking spout). The pinholes are formed by puncturing the membrane using one or more pins having a substantially circular cross-section and formed with the membrane in radial tension such that each pinhole is closed by the surrounding elastomeric material when the pins are removed and the tension is relieved. Accordingly, under normal atmospheric conditions (i.e., when the cup is not in use), the pinholes remain closed, thereby preventing leakage of liquid from the cup through the membrane. During subsequent use, the applied pressure differential causes the membrane to stretch, thereby opening the pinholes and allowing liquid to pass through the membrane and through the drinking spout. Upon removal of the differential pressure, the membrane returns to its original (e.g., planar) shape, and the pinholes are again closed. Because the pinholes are substantially circular (i.e., do not include slits that can fatigue or trap deposits), the pinholes facilitate reliable leakage prevention over a longer period than that possible using conventional, slit-based flow control elements.

The present invention will be more fully understood in view of the following description and drawings.

DETAILED DESCRIPTION

Figure 1:
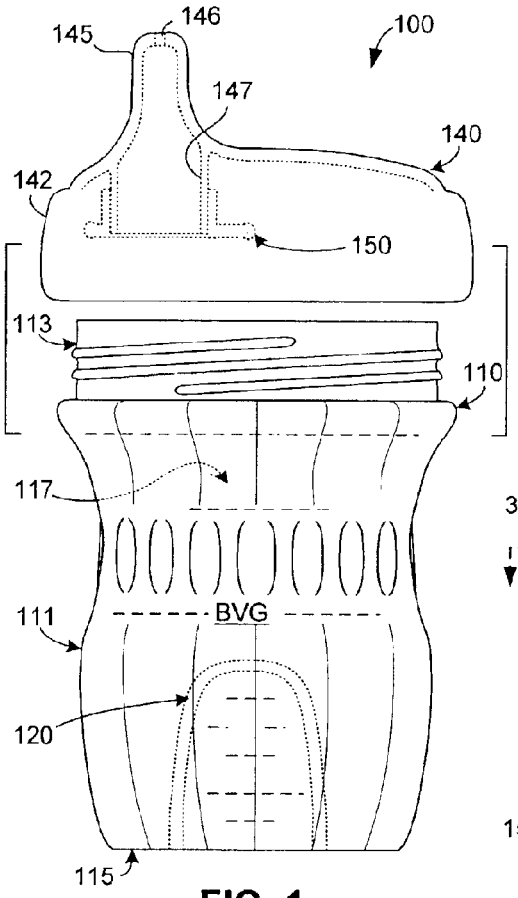
FIG. 1 is a side view showing a sippy cup according to an embodiment of the present invention.

FIG. 1 is a side view showing a sippy cup 100 according to an embodiment of the present invention. Sippy cup 100 generally includes a hollow cup-shaped body 110, a cap 140, and an elastomeric flow control element 150 mounted on cap 140.

Body 110 includes a roughly cylindrical sidewall 111 having a threaded upper edge 113, and a bottom wall 115 located at a lower edge of sidewall 111. Sidewall 111 and bottom wall 115 define a beverage storage chamber 117 in which a beverage BVG is received during use. Body 110 has a height of approximately 4 inches and a diameter of approximately 3 inches. Body 110 is molded from a suitable plastic using known methods. An optional cold plug 120 is mounted on bottom wall 115, as described in co-owned U.S. Pat. No. 6,502,418 issued Jan. 7, 2003, which is incorporated herein by reference.

Cap 140 includes a base portion 142 having threaded inside surface that mates with threaded upper edge 113 to connect cap 140 to body 110, thereby enclosing storage chamber 117. Cap 140 also includes a drinking spout 145 defining an outlet passage 146. Provided at a lower end of drinking spout 145 is a cylindrical mounting structure 147 to which flow control element 150 is press fitted. Cylindrical mounting structure 147 forms a channel through which liquid passes from storage chamber 117 to outlet passage 146. In one embodiment, cylindrical mounting structure 147 has an inner diameter of approximately 0.6 inches and an outer diameter of approximately 0.7 inches.

Figure 2:
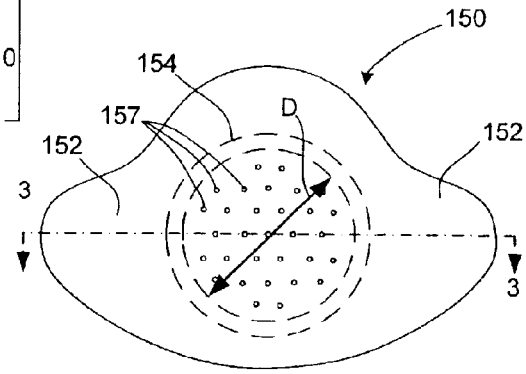
FIG. 2 is a plan view showing a flow control element utilized in the sippy cup of FIG. 1.
Figure 3:
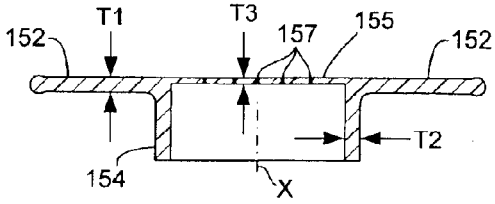
FIG. 3 is a cross-sectional side view taken along section line 3—3 of FIG. 2.

Referring to FIGS. 2 and 3, flow control element 150 is formed from a suitable elastomeric material (e.g., soft rubber, thermoplastic elastomer, or silicone), and includes several peripheral pull-tabs 152, a cylindrical wall 154 extending away from pull-tabs 152, and a membrane 155 extending across one end of cylindrical wall 154. Pull-taps 152 are formed by a flat, relatively thick section of the elastomeric material, and provide convenient handles for removing flow control element 150 from cap 140. Cylindrical wall 154 is also relatively thick, and defines a central axis X that extends substantially perpendicular to the plane defined by pull-tabs 152. In contrast, membrane 155 is relatively thin, and in the disclosed embodiment is located in the plane defined by pull-tabs 152. In one embodiment, flow control element 150 is molded using silicone, pull-tabs 152 have a thickness T1 in the range of 0.06 to 0.1 inches (e.g., approximately 0.08 inches), cylindrical wall 154 has an inner diameter D in the range of 0.25 to 1.5 inches (e.g., approximately 0.7 inches) and a thickness T2 in the range of 0.04 to 0.08 inches (e.g., approximately 0.06 inches), and membrane 155 has a thickness T3 in the range of 0.01 to 0.1 inches (e.g., approximately 0.02 inches).

Figure 4A:
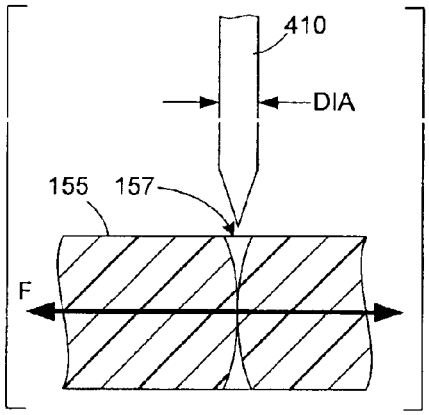
FIGS. 4(A) and 4(B) are simplified enlarged cross-sectional views showing the opening of a pinhole formed in the flow control element of FIG. 2 during operation.

In accordance with the present invention, several pinholes 157 are formed in membrane 155 to facilitate liquid flow from storage chamber 117 through drinking spout 145. As indicated in FIG. 4(A), each pinhole 157 is formed by piercing membrane 155 with a pin 410, or other sharp pointed object, such that the pinhole is closed by the surrounding elastomeric material when pin 410 is subsequently removed. In a preferred embodiment, membrane 155 is stretched in a radial direction by a force F that is sufficient to increase the diameter of membrane 155 in the range of 1 to 10 percent during the formation of pinholes 157. When the stretching force F is subsequently removed (i.e., membrane 155 returns to an unstretched state), pinholes 157 are collapsed by the surrounding membrane material to provide a reliable seal. In accordance with another aspect, each pin 410 is formed with a continuously curved (e.g., circular) cross section such that each pinhole 157 is substantially circular (i.e., does not have a slit or fold that would be formed by a cutting element having an edge). Note that a pin having a diameter DIA of approximately 0.025 inches was used to produce successful pinholes in a membrane having a thickness of approximately 0.02 inches. The number of pinholes 157 and membrane thickness T3 determine the amount of liquid flow through membrane 155 during use for a given pressure differential, as discussed below.

Figure 4B:
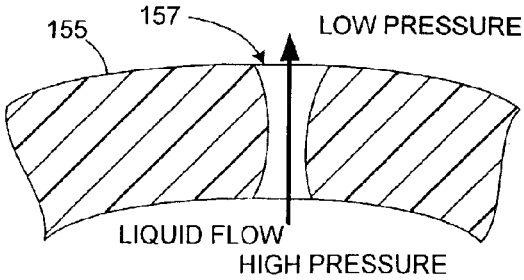

Referring again to FIG. 1, during operation flow control element 150 is mounted onto cap 140 such that cylindrical wall 154 is secured to cylindrical mounting structure 147, which is integrally molded into cap 140, thereby positioning membrane 155 below drinking spout 145. A liquid (e.g., a beverage such as water of juice) is then poured into storage chamber 117 of cup body 110, and cap 140 is secured onto threaded upper edge 113. In this arrangement, membrane 155 is positioned between the liquid beverage in storage chamber 117 and outlet passage 146 of drinking spout 145. While atmospheric equilibrium is maintained (i.e., the pressure inside cup body 110 is equal to the pressure outside cap 140), membrane 155 remains in the unstretched state illustrated in FIG. 4(A), wherein pinholes 157 remain closed to prevent leakage. During subsequent use (e.g., when a child sucks on drinking spout 145), a pressure differential is generated in which the pressure inside storage chamber 117 becomes greater than the pressure in outlet passage 146, thereby causing membrane 155 to stretch toward outlet passage 146, as indicated in FIG. 4(B). The stretching of membrane 155 causes pinholes 157 to open, thereby allowing the liquid beverage to pass therethrough. Subsequently, when the pressure differential is relieved (i.e., the child stops sucking) and atmospheric equilibrium is re-established by back venting through pinholes 157. Membrane 155 then returns to its unstretched state, and pinholes 157 return to the closed state shown in FIG. 4(A). Note that because pinholes 157 do not include slits that can become weakened and/or trap deposits that can prevent slit flap closure, the flow control element of the present invention facilitates leak-free operation that is substantially more reliable than that of slit-based conventional products.

As mentioned above, the number of pinholes 157 determines the amount of liquid flow through membrane 155 during use. Because each pinhole 157 only opens a small amount, the amount of liquid passing through each pinhole 157 during use is quite small. Accordingly, multiple pinholes 157 are arranged in a pattern that collectively facilitate desired flow conditions. In an experiment using a silicone membrane having thickness of 0.02 inches and a diameter of approximately ¾ inches, a pattern of fifteen spaced-apart pinholes was found to produce insufficient liquid flow during normal use, whereas a pattern of forty-nine pinholes 157 was found to produce an optimal liquid flow. Of course, the number and pattern of pinholes 157 depends on a number of factors, and the pattern shown in FIG. 2 is not intended to be limiting.

Figure 5:
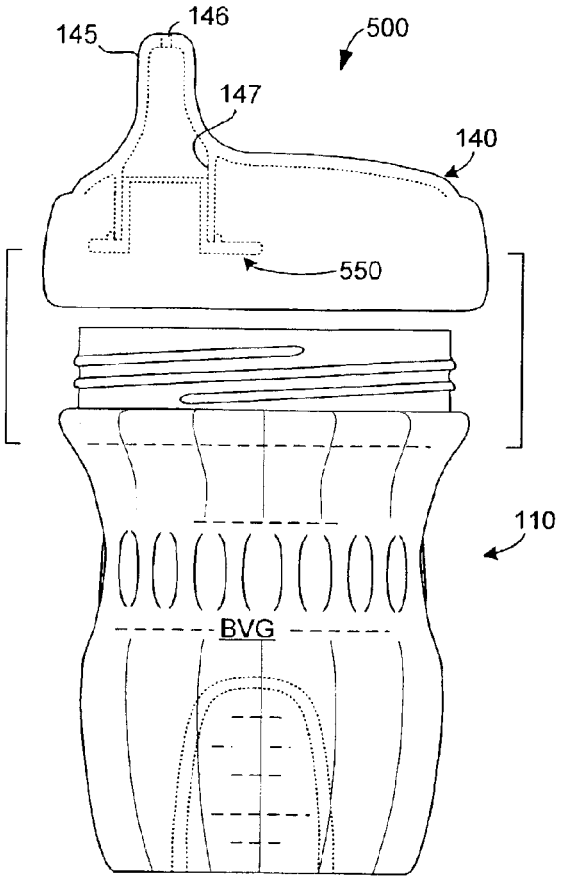
FIG. 5 is a side view showing a sippy cup according to a second embodiment of the present invention.

FIG. 5 is a side view showing a sippy cup 500 according to another embodiment of the present invention. Similar to the first embodiment discussed above, sippy cup 500 utilizes cup-shaped body 110 and cap 140, which are described above. However, sippy cup 500 utilizes an elastomeric flow control element 550 mounted on cap 140 that differs from flow control element 150 in the manner described below.

Figure 6:
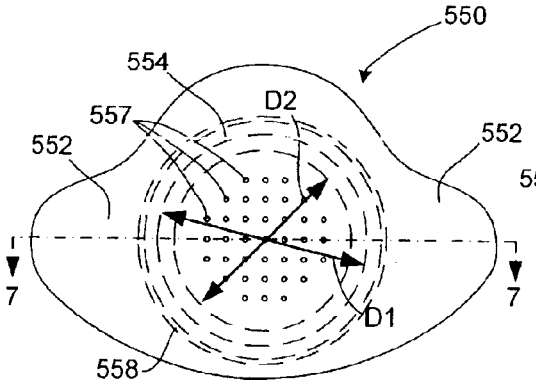
FIG. 6 is a plan view showing a flow control element utilized in the sippy cup of FIG. 5.
Figure 7:
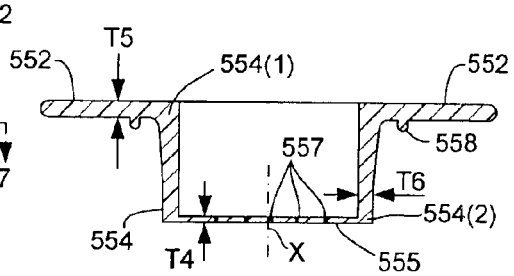
FIG. 7 is a cross-sectional side view taken along section line 7—7 of FIG. 6.

Referring to FIGS. 6 and 7, flow control element 550 is formed from a suitable elastomeric material (e.g., soft rubber, thermoplastic elastomer, or silicone), and includes several peripheral pull-tabs 552, a cylindrical wall 554 extending away from pull-tabs 552, and a membrane 555 extending across the end of cylindrical wall 554 that is located opposite to pull-tabs 552. Similar to the first embodiment, pull-taps 552 are formed by a flat, relatively thick section of the elastomeric material. Cylindrical wall 554 has a first end 554(1), a second end 554(2), and defines a central axis X that extends substantially perpendicular to the plane defined by pull-tabs 552, which are connected to first end 554(1). Membrane 555 is positioned to block an opening defined by second end 554(2) of cylindrical wall 554. The outer diameter D1 of cylindrical wall 554 is provided with a slight taper (as indicated in FIG. 6) to facilitate insertions into cylindrical mounting structure 147 of cap 140 (as shown in FIG. 5), and is sized near first end 554(1) with a suitable interference such that flow control element 550 is secured (i.e., press fitted) to cap 140 when cylindrical wall 554 is pushed into mounting structure 147. An annular bump 558 is also provided to help secure flow control element 550 to cap 140. Because the diameter D1 of cylindrical wall 554 is smaller (i.e., relative to cylindrical wall 154 of the first embodiment) to fit within cylindrical mounting structure 147, membrane 555 necessarily has a diameter D2 that is smaller (e.g., approximately one-half inch) than that of membrane 155 (discussed above), and therefore provides less space for pinholes 557 than that provided in the first embodiment. Therefore, to facilitate a similar fluid flow with the reduced number of pinholes 557 (e.g., thirty-seven), membrane 555 has a thickness T4 (e.g., approximately 0.015 inches) that is smaller than that of membrane 155. As in the embodiment described above, flow control element 550 is molded using silicone, pull-tabs 552 have a thickness T5 of approximately 0.07 inches, and cylindrical wall 554 has a thickness T6 of approximately 0.09 inches adjacent to second end 544(2). Pinholes 557 are formed in the essentially the same manner described above (e.g., by stretching membrane 555 such that diameter D2 is expanded from approximately 4%).

Referring again to FIG. 5, during operation flow control element 550 is mounted onto cap 140 such that cylindrical wall 554 is inserted inside cylindrical mounting structure 147, which is integrally molded into cap 140, thereby positioning membrane 555 adjacent to drinking spout 145. Note that sufficient space is provided between membrane 555 and the adjacent portions of cap 140 to allow the upward stretching of membrane 555 during use. A liquid (e.g., a beverage such as water of juice) is then poured into storage chamber 117 of cup body 110, and cap 140 is secured onto threaded upper edge 113. As in the first embodiment, membrane 555 is positioned between the liquid beverage in storage chamber 117 and outlet passage 146 of drinking spout 145. However, by positioning membrane 555 inside of cylindrical mounting structure 147 close to outlet passage 146, a very small space is provided above membrane 555 for collecting liquid that has passed through membrane 555 but not consumed, which may reduce dripping and leakage when compared to the first embodiment. Membrane 555 otherwise operates in a manner similar to that described above to control the flow of liquid from storage chamber 117 through spout 145.

In addition to the specific embodiments disclosed herein, one or more aspects of the present invention may be incorporated into other spill-resistant containers, such as travel mugs and sport bottles. Other features and aspects may be added to these spill-resistant containers that fall within the spirit and scope of the present invention. Therefore, the invention is limited only by the following claims.

What is claimed is:

1. A spill-resistant beverage container comprising:

a cup-shaped body defining a storage chamber;

a removable cap mounted on the cup-shaped body, the cap including a top wall having at one side an upwardly extending drinking spout defining an outlet passage; and a flow control element including a membrane formed from an elastomeric material that is mounted below the drinking spout such that the membrane is located between the storage chamber and the outlet passage, wherein the membrane defines a plurality of pinholes formed such that each pinhole is closed by the elastomeric material surrounding said each pinhole when the membrane is subjected to normal atmospheric conditions, thereby preventing passage of a liquid from the storage chamber to the outlet passage, and each pinhole is opened when the membrane is subjected to an applied pressure differential that causes the membrane to stretch, thereby facilitating liquid flow from the storage chamber to the outlet passage, and wherein the membrane has a circular outer perimeter having a diameter of 0.25 to 1.5 inches and a thickness of 0.01 to 0.1 inches, and wherein the plurality of pinholes comprises a number greater than ten.

2. The spill-resistant beverage container according to claim 1, wherein the number of pinholes is greater than thirty.

3. The spill-resistant beverage container according to claim 1, wherein the flow control element further comprises a cylindrical wall surrounding the membrane, and a plurality of pull-tabs extending perpendicular to the cylindrical wall.

4. The spill-resistant beverage container according to claim 3, wherein a thickness of the pull-tabs is 0.06 to 0.1 inches, and wherein a thickness of the cylindrical wall is 0.04 to 0.08 inches.

5. The spill-resistant beverage container according to claim 3, wherein the pull-tabs and the membrane are formed at a first end of the cylindrical wall.

6. The spill-resistant beverage container according to claim 3, wherein the pull-tabs is located at a first end of the cylindrical wall, and the membrane is located at a second end of the cylindrical wall.

7. The spill-resistant beverage container according to claim 1, wherein flow control element comprises one of silicone, thermoplastic elastomer, and soft rubber.

8. A flow control element for a beverage container, the flow control element comprising a membrane formed from an elastomeric material and defining a plurality of pinholes formed such that each pinhole is closed by elastomeric material surrounding said each pinhole when the membrane is subjected to normal atmospheric conditions, thereby preventing passage of a liquid through the membrane, and each pinhole is opened when the membrane is subjected to an applied pressure differential that causes the membrane to stretch, thereby facilitating liquid flow through the membrane, wherein the membrane has a circular outer perimeter having a diameter of 0.25 to 1.5 inches and a thickness of 0.01 to 0.1 inches, wherein the plurality of pinholes comprises a number greater than ten, wherein the flow control element further comprises a cylindrical wall surrounding the membrane, and one or more pull-tabs extending perpendicular to the cylindrical wall.

9. The flow control element according to claim 8, wherein the number of pinholes is greater than thirty.

10. The flow control element according to claim 8, wherein a thickness of the pull-tabs is 0.06 to 0.1 inches, and wherein a thickness of the cylindrical wall is 0.04 to 0.08 inches.

11. The flow control element according to claim 8, wherein the pull-tabs and the membrane are formed at a first end of the cylindrical wall.

12. The flow control element according to claim 8, wherein the pull-tabs are located at a first end of the cylindrical wall, and the membrane is located at a second end of the cylindrical wall.

13. The flow control element according to claim 8, wherein flow control element comprises silicone.

14. The flow control element according to claim 8, wherein flow control element comprises thermoplastic elastomer.

15. The flow control element according to claim 8, wherein flow control element comprises soft rubber.

16. A method for manufacturing a flow control element for a beverage container, the flow control element comprising a planar membrane formed from an elastomeric material and defining a radial axis, the method comprising:

stretching the membrane by applying a tensile force along the radial axis; and piercing the stretched membrane using a sharp object to form a pinhole such that the pinhole is closed by elastomeric material surrounding the pinhole when the tensile force is removed and the membrane is subjected to normal atmospheric conditions, thereby preventing passage of a liquid through the membrane, and such that the pinhole is opened when the membrane is subjected to an applied pressure differential that causes the membrane to stretch, thereby facilitating liquid flow through the pinhole.

17. The method according to claim 16, wherein the membrane has a circular outer perimeter defining a diameter, and wherein stretching comprises stretching the membrane along the radial axis such that the diameter is increased by an amount in the range of 1 to 10%.

* * * * *